United States Patent [19]

Pollard

[11] 4,415,117

[45] Nov. 15, 1983

[54] CONTAINER WITH SELF LOCKING BOTTOM

[75] Inventor: William T. Pollard, Hinsdale, Ill.

[73] Assignee: Westvaco Corporation, New York, N.Y.

[21] Appl. No.: 431,161

[22] Filed: Sep. 30, 1982

[51] Int. Cl.[3] ..... B65D 5/10; B65D 5/46

[52] U.S. Cl. ..... 229/39 R; 229/52 B; 229/44 R

[58] Field of Search ..... 229/38, 39 R, 23 A, 229/41 R, 41 B, 52 B, 44 R

[56] References Cited

U.S. PATENT DOCUMENTS

| | | | |
|---|---|---|---|
| 2,065,482 | 12/1936 | Verhonen | 229/39 R |
| 2,186,777 | 1/1940 | Bert | 229/39 R |
| 2,844,296 | 7/1958 | Soja | 229/39 R |
| 3,294,221 | 12/1966 | Notko | 229/39 R |
| 3,473,722 | 10/1969 | Rohde . | |
| 3,512,695 | 5/1970 | Anderson . | |
| 3,539,090 | 11/1970 | Blasdell | 229/38 |
| 3,581,974 | 6/1971 | Freeman | 229/39 R |
| 3,776,108 | 12/1973 | Nock | 229/39 R |
| 4,017,019 | 4/1977 | Booth . | |
| 4,119,266 | 10/1978 | Dempster | 229/39 R |

*Primary Examiner*—Herbert F. Ross

[57] ABSTRACT

A paperboard container formed from a single blank of material with an improved bottom structure comprises opposed female locking panels and opposed male locking panels which provide a self locking bottom consisting of four thicknesses of the blank material. The top of the container also includes a double thick integral handle with a top closure having integral friction locks.

10 Claims, 10 Drawing Figures

CONTAINER WITH SELF LOCKING BOTTOM

BACKGROUND OF INVENTION

The present invention relates to paperboard containers and more particularly to a paperboard container with a strong self locking bottom for carrying heavy products.

It is common practice in the art of paperboard container manufacture to provide containers with reinforced bottoms. The reinforcing may be accomplished with the addition of extra panels to the bottom or with multiple panels sequentially folded into position at the bottom when the container is formed. It is also well known to make reinforced bottoms with interlocking panels. Structures are known for such constructions which use various arrangements of slots, tongues, flaps and the like, but not all such structures have been successful.

Prior constructions have generally been complex and difficult to manufacture and assemble, requiring nonsymmetrical blanks which use too much paperboard, besides being too expensive. Where attempts have been made to simplify such constructions, there has been a sacrifice of strength and durability.

Examples of prior art containers with reinforced bottoms may be found in the following prior U.S. Pat. Nos: 2,186,777 2,844,296 3,473,722 3,512,695 3,539,090 4,017,019. While many efficient self locking closures are presently known, they are usually alike in that the locking panels which are folded inside the container are generally about the same width as the slots provided for folding such panels inside. An exception is illustrated in U.S. Pat. No. 3,473,722, but in the patented container, the locking panels are not full size. In contrast to the above, all bottom panels for the container disclosed herein are full size and contribute to the formation of a four panel bottom of exceptional strength.

SUMMARY OF INVENTION

In accordance with the present invention, an improved self locking bottom structure is provided for a substantially quadrilateral container that is formed from a substantially symmetrical paperboard blank. The container also includes integral handle portions with a friction locked top for convenience in carrying the container. The self locking bottom is formed from four full size thicknesses of the paperboard blank which makes it strong enough for transporting heavy items.

The container is formed from a substantially symmetrical single blank of paperboard that is cut and scored to provide a plurality of side walls, top closure flaps foldably connected to the top edges of said side walls and bottom closure flaps foldably attached to the bottom edges of said side walls. The top closure flaps include at least one pair of integral handle elements while the bottom closure flaps comprise the novel self locking bottom flaps of the present invention. In particular, the bottom closure flaps include at least one pair of female locking panels and at least one pair of opposed male locking panels. The female locking panels are each divided at their midpoint by a score line and each includes an elongated slot that is perpendicular to and bisected by the midpoint score line. Meanwhile, the male locking panels are also divided at their midpoint by a cut/score line into inner and outer portions. The outer portions are further divided into three segments by additional score lines that are perpendicular to and which terminate at the cut/score lines.

When the container is set up and the self locking bottom prepared, the female locking panels are folded over upon themselves at their midpoint score lines and then each is folded inwardly to abut one another in the plane of the container bottom. Then, the outer portion segments of the male locking panels are each folded over so that the segments lie adjacent to and on top of one another. In this condition, the outer portion segments of each male locking panel are inserted within the slots provided in each female locking panel into the inside of the container. At this point they are subsequently unfolded to their flat condition to lie in a plane that is parallel to the plane of the container bottom. This construction yields a self locking bottom with four full size thicknesses of paperboard that is strong and sturdy. In an alternative method of construction, the female locking flaps may be folded over upon themselves about their dividing lines and then folded inside the container to lie adjacent the side walls. Next, the male locking flaps are folded inwardly of the container where the inner portions thereof lie in the plane of the bottom of the container and the outer portion segments are folded to lie adjacent to one another as before in an upright condition. At this point, the pre-folded female locking flaps may be folded downwardly about the outer portion segments and the outer portion segments can then be unfolded to lie over the pre-folded female locking flaps as in the first method.

Accordingly, it is an object of the present invention to construct a stronger more stable self locking bottom for a container with a minimum amount of paperboard and at minimum cost.

Another object is to provide a self locking bottom that can readily be assembled by hand or using modern automated equipment.

Yet another object of the present invention is to provide a paperboard container having great bottom strength and an integral handle so that it can be used for carrying very heavy loads.

A further important object of the invention resides in the provision of a self locking bottom structure which utilizes the weight of the contents to assist in keeping the bottom closed.

DETAILED DESCRIPTION

Figure 1:
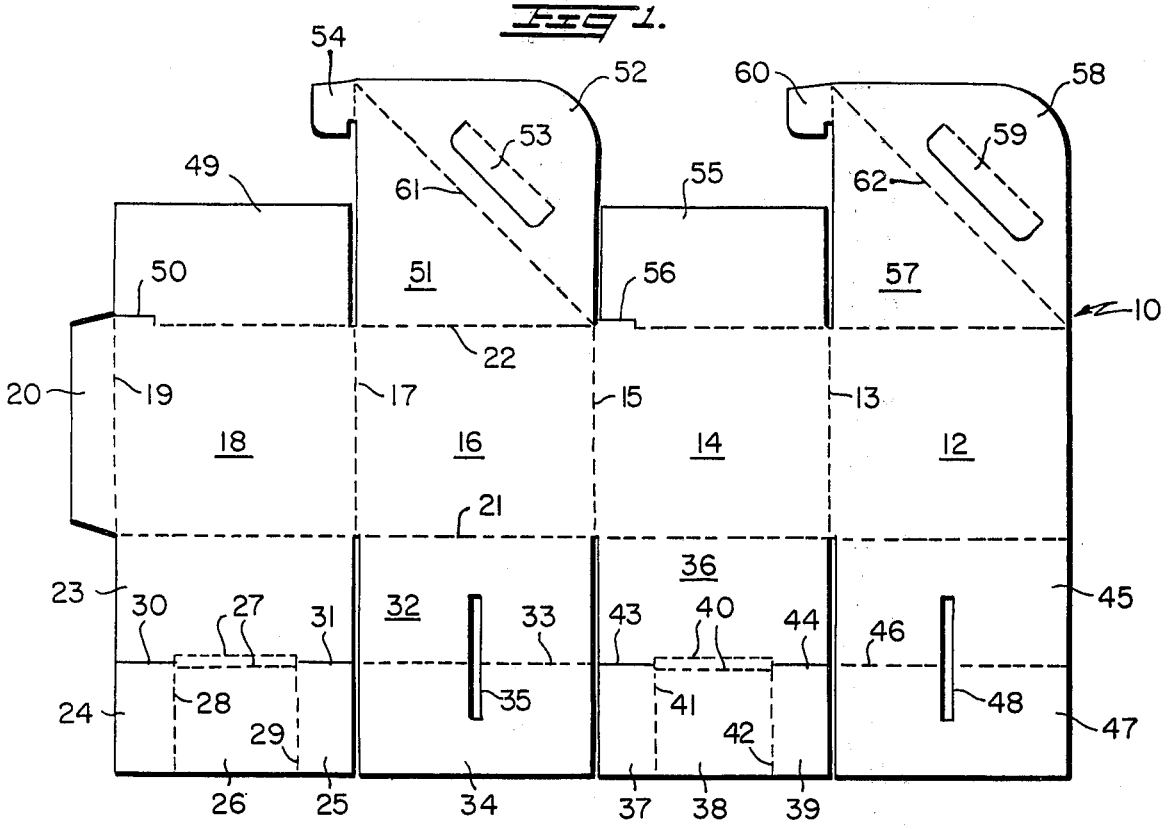
FIG. 1 is a plan view of a paperboard blank from which the container of the present invention may be constructed.

As shown in the drawings, the container of the present invention is prepared from a single blank of paperboard or the like, and preferably corrugated paperboard. The blanks are cut, scored and printed by the manufacturer and after gluing are shipped in a flat collapsed condition to the user where they are set up for use. FIG. 1 discloses a plan view of a blank 10 from which the container may be prepared. The central section of the blank comprises side walls 12,14,16 and 18 separated by score lines 13,15 and 17. A glue flap 20 is foldably attached to side wall 18 along a score line 19. The blank is initially set up by adhering glue flap 20 to the inside of side wall 12. Meanwhile, a plurality of self locking bottom flaps are connected to the bottom of the side walls along a score line 21 and a plurality of top closure flaps are connected to the side walls along score line 22.

Figure 2:
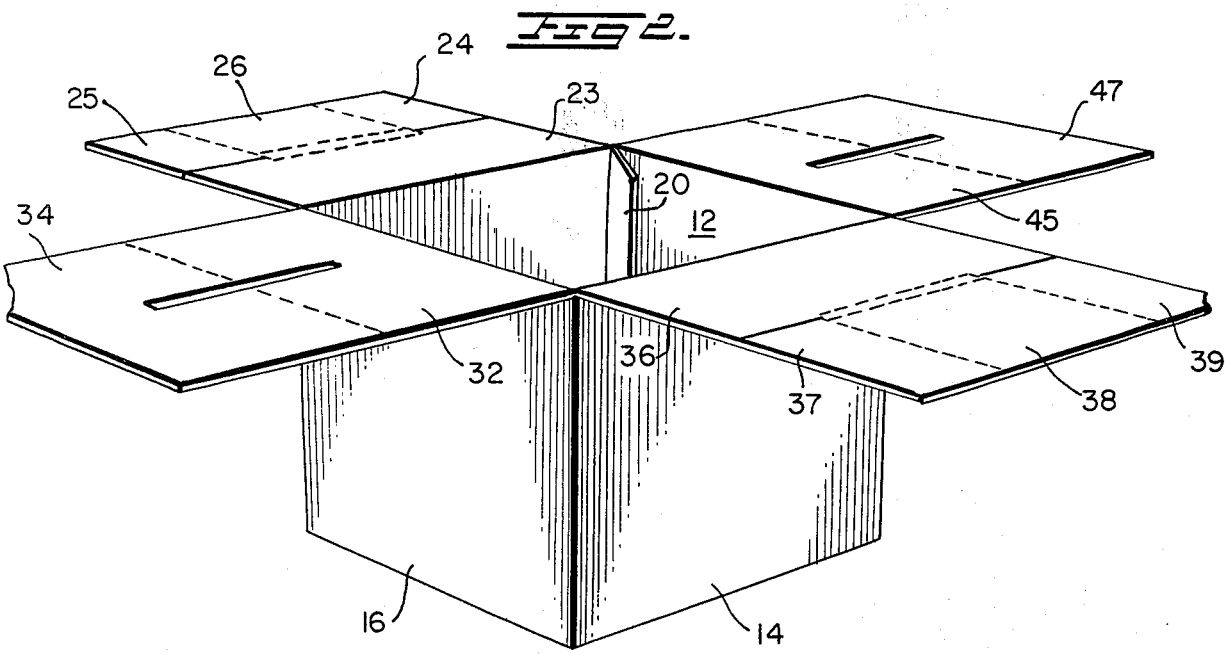
FIG. 2 is an inverted perspective view of the bottom of a partially erected container prepared from the blank of FIG. 1.

The self locking bottom closure flaps comprise a pair of opposed male flaps and a pair of opposed female flaps particularly as shown in FIG. 2. The male closure flaps comprise first or inner portions 23 and 36 connected to side walls 18,14 and second or outer portions which consist of individual panels 24,25,26 and 37,38,39. The inner and outer portions are separated from one another along cut/score lines 30,31 and 27 and 43,44 and 40. The scored portions 27 and 40 are shown as double scores because they must fold around a double thickness of the blank material when the container is formed. The cut portions 30,31 and 43,44 intersect the scored portions 27,40 an equal distance from the respective flap edges and form the termination point for the perpendicular score lines 28,29 and 41,42 which divide the outer portions of the male locking flaps into their individual segments or panels 24,25,26 and 37,38,39.

The female locking flaps comprise inner and outer portions 32,34 divided by a score line 33, and portions 45,47 divided by a score line 46. The score lines 33,46 are substantially aligned with the cut/score lines in the male locking flaps and are located at about the midpoint of the flaps. These score lines divide the female locking flaps into equal sized portions that are each about one-half the width of the container. Each of the female locking flaps further include locking slots 35,48 that substantially bisect the score lines 33,46 and which have lengths that are generally equal to the width of the central panels 26,38 of the male locking flaps. The width of the locking slots 35,48 is equal to about three times the thickness of the blank material in order to accomodate the male locking flaps when the self locking bottom is formed.

The preferred top closure flaps include an integral handle means for easy carrying of the container. The top closure flaps comprise single flaps 49 and 55 connected to side walls 18 and 14 along score line 22, the double flaps 51,52 and 57,58 connected to side walls 16,12 along score line 22. The portions 51,57 of the double flaps include friction locking tabs 54,60 that are inserted in slots 50,56 along score line 22 when the container is closed, and the portions 52,58 comprise the handle portions of the top closure double flaps. Each handle portion 52,58 includes a cut out 53,59. These handle portions ultimately end up in a side-by-side condition when the container is set up so that the cut outs 53,59 may form a single hand hole cut out for the container handle.

Figure 3:
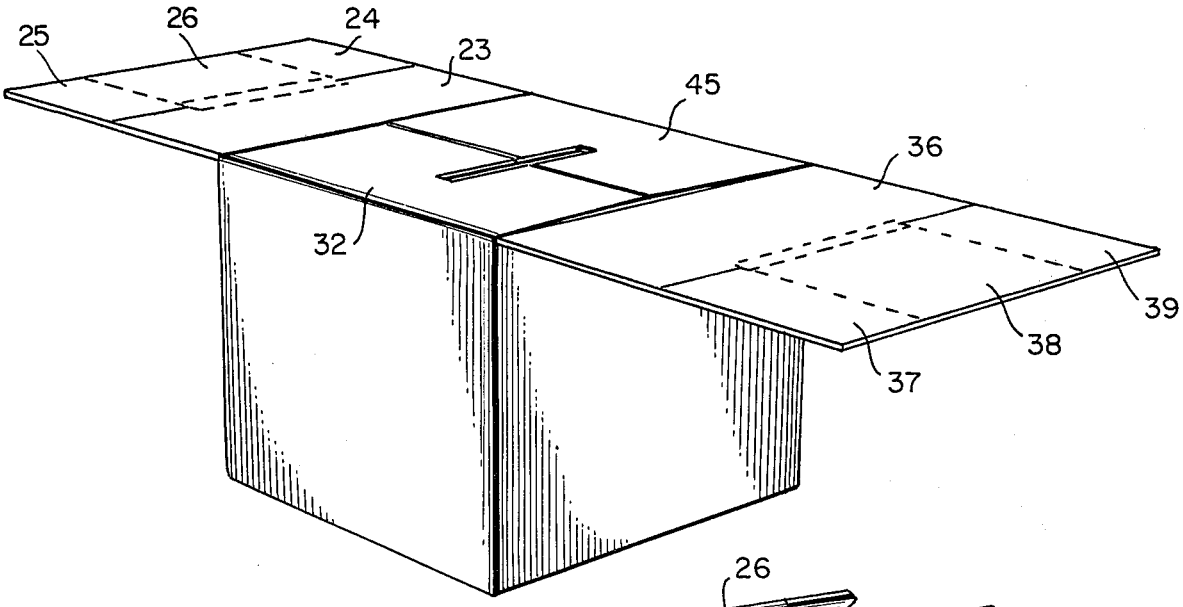
FIG. 3 is a view similar to FIG. 2 showing the first assembly step for making the self locking bottom.
Figure 4:
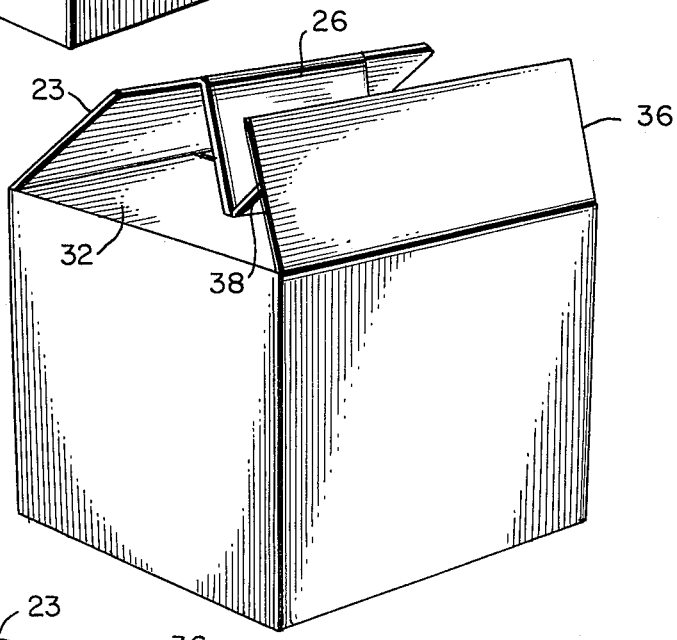
FIG. 4 is a view similar to FIG. 3 showing the second assembly step for making the self locking bottom.
Figure 5:
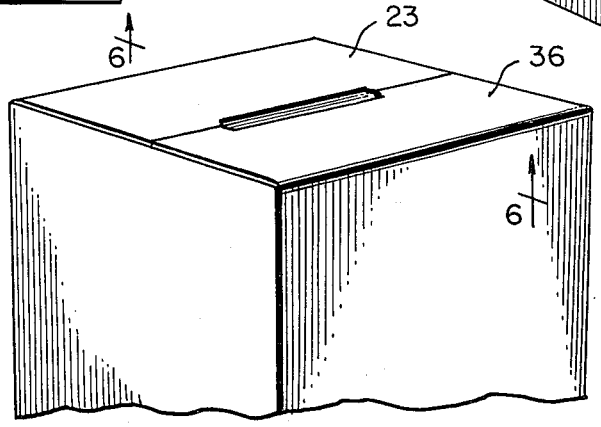
FIG. 5 is a view similar to FIG. 4 showing the outside of the completed bottom construction.
Figure 6:
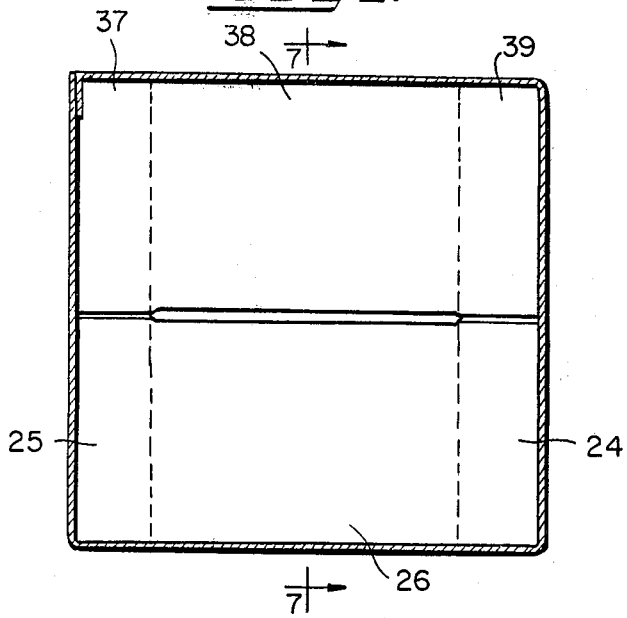
FIG. 6 is a plan view taken in the direction of the arrows 6—6 of FIG. 5 showing the inside of the completed bottom construction.
Figure 7:
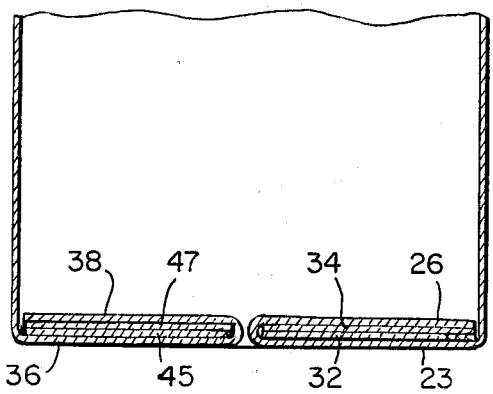
FIG. 7 is a side view taken in the direction of the arrows 7—7 of FIG. 6 showing the construction of the completed bottom.

FIG. 2 shows the preformed blank in an inverted position wherein the self locking bottom may be formed. In this condition, the male locking flaps are opposed and the female locking flaps are opposed. Initially, as shown in FIG. 3, the female locking flap portions 32,34 and 45,47 are folded over adjacent to one another about their score lines 33,46 and then these doubled flaps are folded over into the plane of the bottom about score line 21. Next, the male locking flaps are arranged to fit within the slots 35,48 of the female locking flaps. For this purpose, the individual flap portions 24,25,26 and 37,38,39 are folded adjacent to one another and inserted into the combined slots 35,48 of the female locking panels as shown in FIG. 4. After the combined panels 24,25,26 and 37,38,39 are inserted inside the container, the outer flap portions are returned to their normal position to overlie the inside female flaps 34,47. FIG. 5 shows the outside of the bottom of the container and FIG. 6 shows the inside with panels 24,25,26 and 37,38,39 in their normal condition. These folding steps produce a bottom consisting of four thicknesses of the blank material. FIG. 7 shows this construction with panels 23 and 24,25,26 encompassing panels 32 and 34 of the female locking flap attached to side wall 16, and panels 36 and 37,38,39 encompassing panels 45 and 47 of the female locking flap attached to side wall 12. The male and female flaps remain locked in this condition, especially when goods are placed in the container to hold the panels 24,25,26 and 37,38,39 down. The aforementioned sequence describes the preferred method for forming the self locking bottom. The same structure could be achieved by other means if desired, particularly by initially folding the doubled female locking flaps inside the container before inserting the male locking flap panels 24,25,26 and 37,38,39 into the combined slots 35,48.

Figure 8:
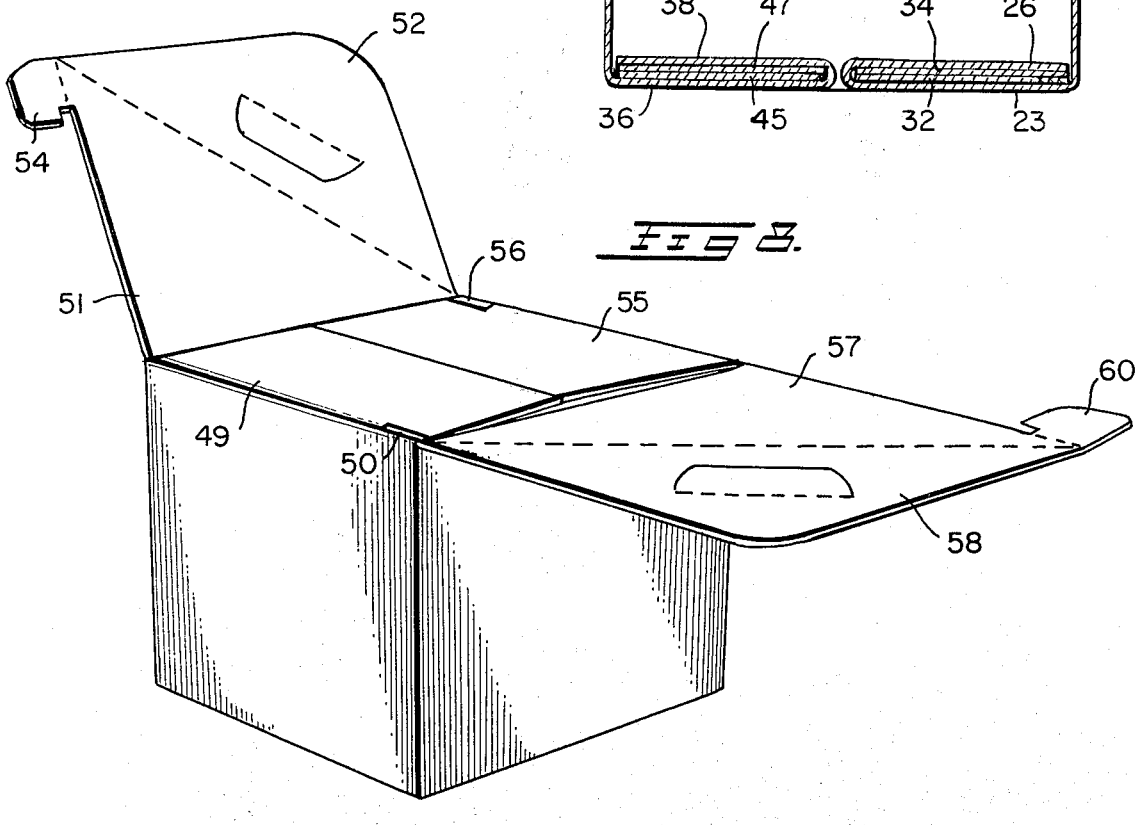
FIG. 8 is a perspective view of the top of the container of the present invention showing the first assembly step.
Figure 9:
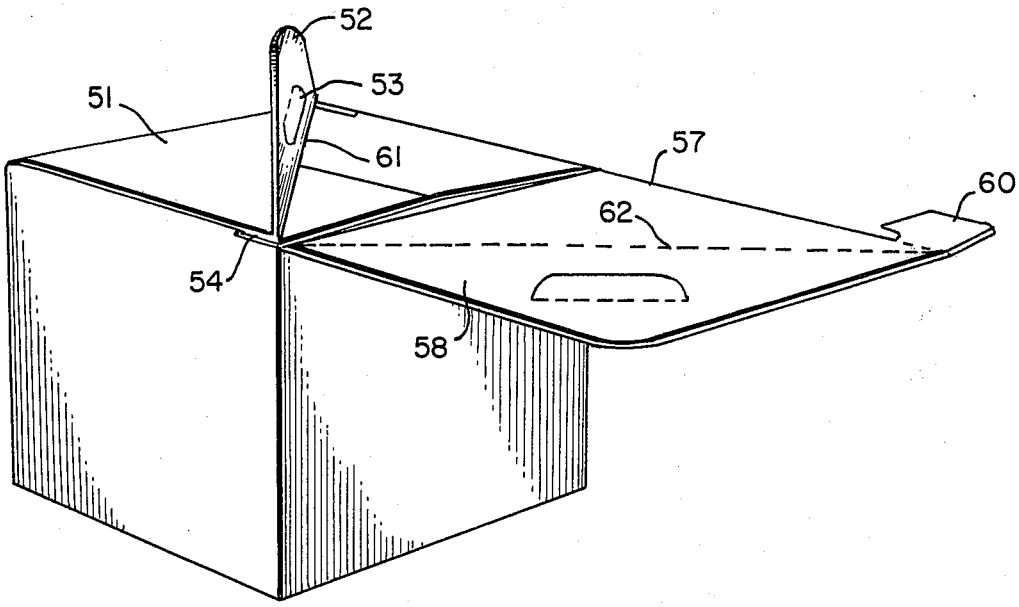
FIG. 9 is a view similar to FIG. 8 showing a second assemby step for the top of the container; and, FIG. 10 is a perspective view of the fully assembled container of the present invention.

The top of the container is formed substantially as shown in FIGS. 8 and 9. Initially panels 49,55 are folded over into the plane of the top. Then, panels 51 and 57 are folded to lie in a plane directly over panels 49,55 and the handle portions 52,58 are folded upwardly about score lines 61,62 to lie adjacent to one another. In this condition the hand hole cut outs 53,59 coincide and the flap portions thereof can be engaged to hold the panels 52,58 together. The top panels 51,57 are held in place by inserting the tabs 54,60 into their respective slots 50,56.

Figure 10:
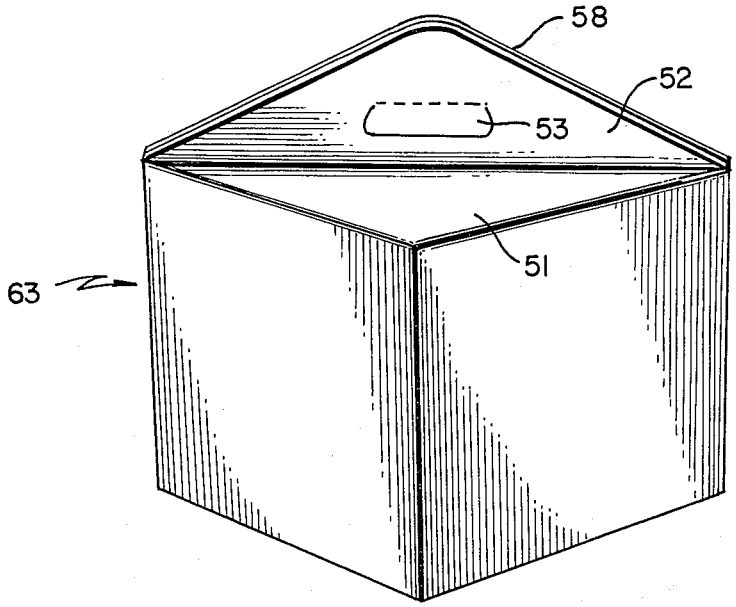

The completely assembled container 63 is shown in FIG. 10. Thus, it may be seen that an effective and strong self locking bottom container has been provided which is capable of being readily set up or collapsed when desired. The reinforced bottom is effected without complicating the configuration of the blank or producing an undesirable amount of waste material during formation of the blank.

In as much as the present invention may be subject to many changes, modifications and variations in detail, it is intended that the foregoing specification and claims be interpreted as illustrative of but a single embodiment. Accordingly, the true scope of the present invention shuld be measured by the appended claims.

I claim:

1. A container formed from a single blank of foldable material comprising a plurality of foldably connected side walls, self locking bottom flaps foldably connected to the bottom edges of said side walls and top closure flaps with integral handle portions and locking elements foldably connected to the top edges of said side walls, said self locking bottom flaps comprising opposed female locking flaps and opposed male locking flaps which are engaged and interlocked in an overlapping manner to produce a container bottom consisting of four thicknesses of the blank material, said top closure flaps comprising first and second pairs of opposed flaps, two of which have diagonal score lines which divide the flaps into handle portions and closure portions.

2. The container of claim 1 wherein the opposed female locking flaps of said self locking bottom are each divided in half by first score lines arranged parallel to the score lines about which the female locking flaps are foldably attached to said side walls and said first score lines are bisected by locking slots arranged perpendicular thereto, said locking slots having a width equal to about three thicknesses of said blank material.

3. The container of claim 2 wherein the two halves of each female locking flap are folded adjacent to one another and then folded into the plane of the bottom of the container in the final condition of the self locking bottom.

4. The container of claim 3 wherein the opposed male locking flaps of said self locking bottom are each divided into inner and outer portions by cut/score lines arranged substantially centrally thereof and parallel to the score lines about which the male locking flaps are foldably attached to said side walls, said outer portions being further divided into three segments by paired score lines arranged perpendicular to said cut/score lines and spaced inwardly an equal distance from the respective flap edges.

5. The container of claim 4 wherein the segments of the outer portion of each male locking flap are folded adjacent to one another prior to being inserted into the locking slots of each female locking flap.

6. The container of claim 5 wherein the segments of each outer portion of each male locking flap are folded back into their aligned condition inside the container to overlie the folded halves of said female locking flaps in the final condition of the self locking bottom to produce a self locking bottom consisting of four full sized thicknesses of blank material.

7. The container of claim 6 wherein the pair of opposed top closure flaps containing diagonal score lines comprise first portions which lie in the plane of the top of the container and second handle portions which rise perpendicular from said first portions and extend diagonally from one corner of said container to an opposed corner.

8. The container of claim 7 wherein the handle portions of said top closure flaps each include hand hole cut outs which coincide with and become engaged with one another when said handle portions are arranged adjacent to one another.

9. The container of claim 8 wherein the first portions of said top closure flaps each include locking tabs which are inserted in locking slots provided therefor along the score lines which connect the first pair of top closure flaps to their respective side walls.

10. A blank for a container having a self locking bottom and an integral, handled top comprising, a plurality of side walls foldably connected together along spaced parallel score lines, a glue flap foldably connected to one of said side walls, a plurality of top closure flaps foldably connected to the upper edges of said side walls along a common score line and a plurality of bottom closure flaps foldably connected to the lower edges of said side walls along a common score line, said top closure flaps comprising first and second pairs of flaps connected to alternate side walls, said first pair of top closure flaps comprising elongated flaps with locking slots in one corner thereof located substantially along the common score line connecting said flaps to the side walls, said second pair of top closure flaps comprising first portions attached to alternate side walls and including locking tabs for cooperating with said locking slots and second portions connected to said first portions along diagonal score lines, said second portions including hand hole cut outs which cooperate with one another when said blank is formed into a container, said bottom closure flaps comprising pairs of female locking flaps and male locking flaps connected to alternate side walls, said female locking flaps comprising full width flaps divided at their midpoint by score lines arranged substantially parallel to the common score line connecting said bottom closure flaps to said side walls and locking slots perpendicular to and bisecting said score lines into equal lengths, said male locking flaps comprising full width flaps divided into two portions at their center by cut/score lines coextensive with the score lines for said female locking flaps, the outer portions of which are further divided into individual segments by score lines arranged perpendicular to said cut/score lines and spaced inwardly an equal distance from the respective flap edges.

* * * * *